US009605400B2

(12) United States Patent
Fraenkel et al.

(10) Patent No.: US 9,605,400 B2
(45) Date of Patent: Mar. 28, 2017

(54) METHODS AND APPARATUS FOR THE INSTALLATION OF COLUMNS/PILES

(75) Inventors: Peter L. Fraenkel, London (GB); Richard Montague, Bristol (GB)

(73) Assignees: MARINE CURRENT TURBINES LIMITED, Frimley, Camberley (GB); BAUER MASCHINEN GmbH, Schrobenhausen (DE)

( * ) Notice: Subject to any disclaimer, the term of this patent is extended or adjusted under 35 U.S.C. 154(b) by 0 days.

(21) Appl. No.: 13/260,745

(22) PCT Filed: Mar. 29, 2010

(86) PCT No.: PCT/GB2010/000611

§ 371 (c)(1),
(2), (4) Date: Mar. 26, 2012

(87) PCT Pub. No.: WO2010/112832

PCT Pub. Date: Oct. 7, 2010

(65) Prior Publication Data

US 2012/0177447 A1 Jul. 12, 2012

(30) Foreign Application Priority Data

Apr. 1, 2009 (GB) ..... 0905663.1

(51) Int. Cl.

| | |
|---|---|
| ***E02D 7/00*** | (2006.01) |
| ***E02D 27/42*** | (2006.01) |
| ***E02D 5/28*** | (2006.01) |
| ***E02D 7/22*** | (2006.01) |
| ***E02D 13/04*** | (2006.01) |
| ***E02D 27/52*** | (2006.01) |

(52) U.S. Cl.

CPC ..... *E02D 27/42* (2013.01); *E02D 5/285* (2013.01); *E02D 7/22* (2013.01); *E02D 13/04* (2013.01); *E02D 27/52* (2013.01)

(58) Field of Classification Search

CPC ..... E02D 13/04; E02D 27/42; E02D 27/52; E02D 5/285; E02D 7/22; E21B 7/124; E21B 15/02

USPC .... 405/224, 228, 229, 231, 232, 252.1, 253; 175/5, 6, 244

See application file for complete search history.

(56) References Cited

U.S. PATENT DOCUMENTS 3,328,969 A * 7/1967 Murphy ..... E02D 7/00 104/35
3,741,320 A * 6/1973 Hilfing ..... 175/6
(Continued)

FOREIGN PATENT DOCUMENTS

CN 1308001 A 8/2001
EP 0 301 114 A1 2/1989 ..... E02D 7/02
(Continued)

*Primary Examiner* — John Kreck
*Assistant Examiner* — Carib Oquendo
(74) *Attorney, Agent, or Firm* — Studebaker & Brackett PC

(57) ABSTRACT

A method and apparatus for mounting a column/pile in an upstanding position on a supporting surface comprising the steps of lowering the column/pile to be installed from a support vessel into contact with the supporting surface, using the lower/toe end of the column/pile as a drill such as to form a bore in the supporting surface into which the lower region of the column/pile is to be located and leaving the column/pile in situ in the bore after the completion of a drilling operation.

12 Claims, 6 Drawing Sheets

(56) References Cited

U.S. PATENT DOCUMENTS

| | | | | | |
|---|---|---|---|---|---|
| 3,891,037 | A * | 6/1975 | Well | B63C 11/40 | 173/152 |
| 4,181,455 | A | 1/1980 | Stanwick | | |
| 4,657,092 | A * | 4/1987 | Franks, Jr. | 175/232 | |
| 4,818,149 | A | 4/1989 | Kuehn | 405/228 | |
| 4,872,514 | A | 10/1989 | Kuehn | 173/132 | |
| 5,244,312 | A | 9/1993 | Botros | | |
| 7,380,614 | B1 * | 6/2008 | Williamson et al. | 175/6 | |
| 2004/0074560 | A1 | 4/2004 | Degen et al. | 141/100 | |
| 2008/0053358 | A1 * | 3/2008 | Owen et al. | 114/274 | |
| 2010/0119309 | A1 | 5/2010 | Gibberd | 405/228 | |

FOREIGN PATENT DOCUMENTS

| | | | | | |
|---|---|---|---|---|---|
| EP | 0301114 | A1 | 2/1989 | | |
| EP | 1493868 | A1 | 1/2005 | | |
| GB | 1333472 | A | 10/1973 | | |
| GB | 2 448 358 | A | 10/2008 | E02B 17/02 | |
| GB | 2448358 | * | 10/2008 | E02B 17/02 | |
| GB | 2448358 | A | 10/2008 | | |
| JP | S6198818 | A | 5/1986 | | |
| JP | S62291324 | A | 12/1987 | | |
| RU | 2071531 | C1 | 1/1997 | | |
| WO | WO 8601556 | A1 | 3/1986 | | |
| WO | WO 02/35013 | A1 | 5/2002 | E02D 15/06 | |

* cited by examiner

METHODS AND APPARATUS FOR THE INSTALLATION OF COLUMNS/PILES

CROSS-REFERENCE TO RELATED APPLICATIONS

This application is related to and claims all available benefit of international application PCT/GB2010/000611 filed Mar. 29, 2010, which in turn claims benefit to British application GB0905663.1 filed Apr. 1, 2009.

BACKGROUND

This invention relates to the methods of and apparatus for the installation of columns/piles and more particularly submerged columns/piles.

In particular, the present invention is concerned with the installation of upstanding columns/piles that are intended to serve as supports for the mounting of installations above or below a water surface. Such installations can be of many forms or purposes, such as for example, supporting submerged water driven turbine installations, and/or wind driven turbine installations.

It is convenient to note that methods and apparatus for generating power from sources other than the combustion of hydrocarbon materials are known and in particular the generation of power from sea and rivers water flows together with the development of power from the movement of air by the use of wind turbines with both involving the mounting of the associated wind or water driven turbine/rotor assembly upon a column/pile upstanding from a sea or river bed.

Whether or not a submerged water driven turbine or an air driven turbine is involved in such power generation the column/pile upon which it is mounted needs to be very firmly anchored in its upstanding position so as to be able to withstand forces that may be imposed upon the column/piles by water and air flows.

It will be clear that in the case of the mounting of columns/piles in water presents considerable operational difficulties.

SUMMARY

Whilst the above observations have been made in relation to the mounting of columns/piles in relation to power generation it is convenient to note that, for example, water submerged columns/piles may be used in connection with other forms of installation such as support columns, for example, for bridges. Broadly according to a first aspect of the invention there is provided a method of mounting one or more a column/pile in an upstanding position on a supporting surface formed by a lake, sea or river bed comprising the steps of lowering the column/pile to be installed from a support vessel into contact with the supporting surface, using the lower/toe end of the column/pile as a drill such upon rotation of the column/pile a bore is formed in the supporting surface into which the lower region of the column/pile is to be located and leaving the column/pile in situ in the thus formed bore after the completion of a drilling operation.

If desired, a reverse fluid circulation is used during the drilling operation such that drill cutting debris is discharged into the water at the head of the column/pile by using a flow of compressed air derived from the support vessel by way of a flexible umbilical.

Also if desired a forward fluid circulation can be used during the drilling operation such that drill cutting debris is discharged into the water at the bed of the water within which drilling takes place using a flow of fluid supplied from the support vessel by way of a flexible umbilical.

Preferably a submersible drilling machine is used for mounting one or more columns/piles to be inserted in the supporting surface, and deploying the machine from the surface support vessel so that it rests on the supporting surface, remotely operating from the support vessel one or more drilling mechanisms by way of one or more flexible umbilicals for delivering power to and for controlling the operation of the drilling machine, and following a required drilling operation recovering the drilling machine by the support vessel to leave one or more columns/piles upstanding from the supporting surface.

Conveniently when installing one or more foundation columns/piles in a lake, river or sea bed, a submersible drilling machine can incorporate one or more drilling mechanisms the machine being deployable with the aid of a surface support vessel so as to be able to rest on the lake, river, or sea bed as to be fully supportable by the lake, river or sea bed, means for remotely operating from the support vessel said one or more drilling mechanisms by way of one or more flexible umbilicals for delivering power to and for controlling the machine, and mains whereby following a required drilling operation the machine recoverable by the support vessel thereby to leave one or more columns/piles upstanding from the lake, river or sea bed.

Preferably the machine incorporates telescopic legs or otherwise articulated members whereby the operational position of the drilling machine is positionally adjustable relative to the support surface in such manner as to level the machine so that its drilling mechanisms are able to produce a vertical bores in the supporting surface.

If desired the machine incorporates position adjustment actuators such as hydraulic cylinders, pneumatic cylinders, bags or bladders or the like.

In a preferred construction each column/pile to be installed is cylindrical it includes at its lower/toe end rock or soil cutters in such manner that on rotation of the column/pile about its longitudinal axis the column/pile effectively acts as a rotary drill, and wherein the machine incorporates means for rotating the column/pile thereby to perform a drilling operation.

In a further preferred construction the machine includes means for enabling the drilling means of the machine to be positionally indexed from the site of a drilling operation to a site for the next following drilling operation without bodily moving the machine, the arrangement being such that a predetermined pattern of column/piles can be established without moving the entire machine.

In a preferred further construction the drilling machine is recoverable to the support vessel whereby the machine can be equipped with a further column/pile and returned to a different location of the machine the arrangement being such as to allow a multiplicity of columns/piles to be installed in a predetermined pattern without moving the entire machine. In a further aspect of the construction of the apparatus the machine is provided with a plurality of drilling mechanisms whereby the drilling of a prearranged installation pattern of the columns/piles is facilitated.

In a further construction of the apparatus the machine includes means such as hydrofoils for utilizing the flow of water in the vicinity of the machine to create a net force that assists gravity in holding the machine onto the lake, river or sea bed.

Preferably the machine incorporates telescopic legs or otherwise articulated members whereby the operational position of the drilling machine is positionally adjustable in such manner as to level the machine so that its drilling mechanisms are able to produce a vertical bore in the lake, river or sea bed. Conveniently, the machine incorporates position adjustment actuators such as hydraulic cylinders, pneumatic cylinders, bags or bladders or the like.

BRIEF DESCRIPTION OF THE DRAWINGS

For a better understanding of the invention and to show how the invention may be carried into effect reference will now be made to the accompanying drawings in which:—

DESCRIPTION OF PREFERRED EMBODIMENTS

Figure 1A:
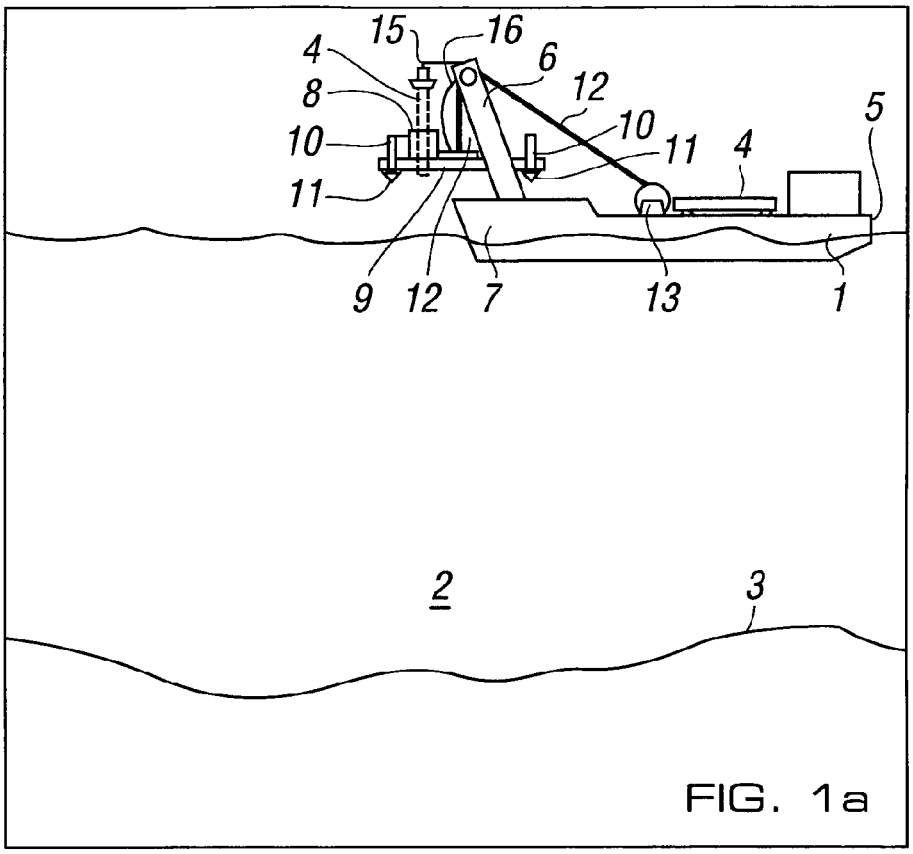
FIGS. 1*a* to 1*h* schematically illustrate successive stages in the positioning and locating of a first embodiment of apparatus for installing and mounting a column/pile upon a lake, sea or river bed.

Referring now to the drawings and in particular to FIG. 1*a*. This Figure schematically illustrates a surface vessel 1 positioned in the vicinity of a location 2 of a sea/river bed 3 at which it is required to install an upstanding columns/pile 4.

As illustrated in the Figure the surface vessel 1 carries a column/pile 4 or several columns/piles 4 to be mounted in the sea/river bed 3. In the Figure such columns/piles are shown as being located at the stern end 5 of the vessel 1. A derrick/crane installation 6 is located at the stem end 7 of the vessel supports a drilling machine 8 which incorporates a main platform section 9 mounting a plurality of telescopic legs 10 having profiled feet 11 that are intended to engage with the lake, sea or river bed 3 in the vicinity of the required location 2. The drilling machine 8 is suspended for deployment into the water by means of a cable 12 and an associated winch assembly 13.

At this stage a column/pile 4 to be installed in the sea/river bed 3 is shown as being vertically positioned on the drilling machine 8 in its drilling position. In other words a column/pile 4 is pre-installed on the drilling machine 8.

The drilling machine 8 incorporates equipment for rotating the column/pile 4 carried thereby in order to carry out an installing operation. Arrangements for operating the drilling machine are provided in the form of flexible umbilical connections 15, 16 operationally connected between the drilling machine 8 and associated control equipment (not shown) provided on the vessel 1.

The vessel 1 is maintained in its required operational position throughout a drilling operation by appropriate vessel positioning arrangements such as mooring cables and/or a dynamic vessel positioning systems (not shown)

Figure 1B:
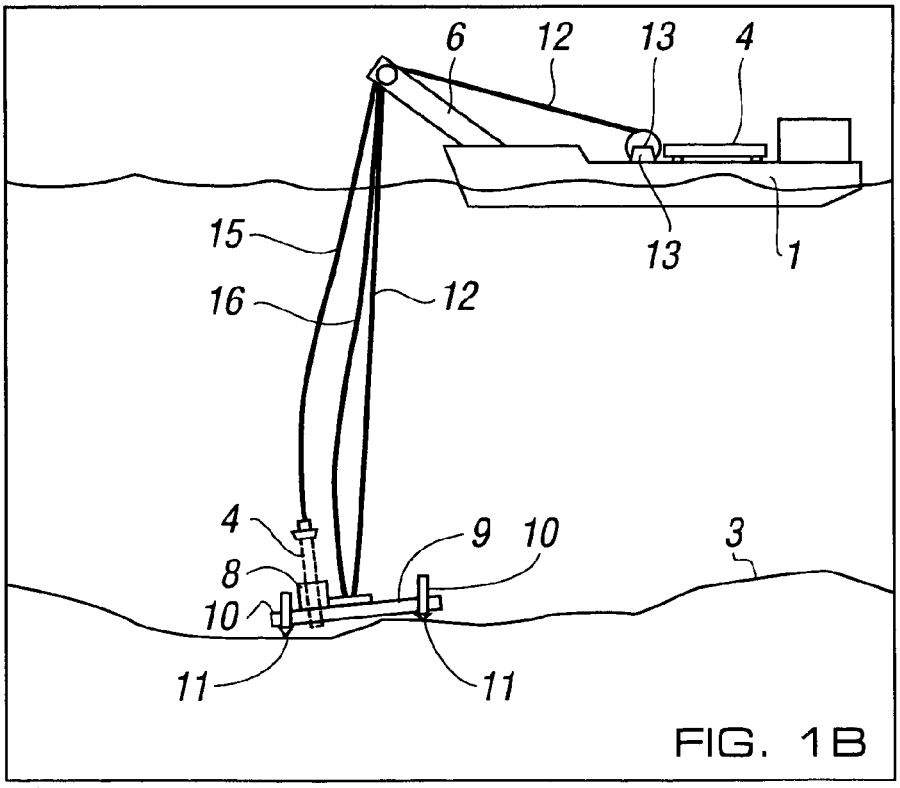

It will be appreciated that during travel of the vessel 1 to the required column/pile installation position 2 the drilling machine 8 would be positioned by the winch assembly 13 inboard of the vessel and once the required position 2 of the lake, sea or river bed 3 at which it is required to install the column/pile 4 has been reached the drilling machine 8 is moved by the winch assembly 13 to a positional setting at in which it can be lowered by the winch assembly 13 down to the sea machine bed 3 to the position as shown in FIG. 1*b*.

At this stage of the installation of the drilling it will be noted that since the lake, sea or river bed is uneven the drilling machine 8 is not level, and that the weight of the drilling machine 8 is totally supported by the fact of its resting on the lake, sea or river bed 3. In this situation the winch assembly cable 12 is arranged to be slack as are the umbilical connections 15/16. This situation accommodates possible displacement and heave movements of the vessel 1 arising from the action of wind, tide, and wave motions on the vessel. It will be understood that during such deploying of the drilling machine 8 the vessel is positioned to ensure that the drilling machine 8 is deposited upon the lake, sea or river bed as accurately as possible to the required site 2 of the column/pile to be mounted.

This accuracy of positioning, in practice, is a matter of importance particularly where more than one column/pile 4 is involved in the mounting of a base support unit for a larger column/pile or installation.

Once the drilling machine 8 is resting upon the lake sea or river bed 3 it is necessary to adjust the leveling of the drilling machine platform 9 such that it is horizontal and that the column/pile 4 to be inserted into the sea bed is positioned immediately above the required mounting position. This leveling is achieved by appropriate adjustments to the lengths of the telescopic legs 10 projecting beneath the platform 9.

Figure 1C:
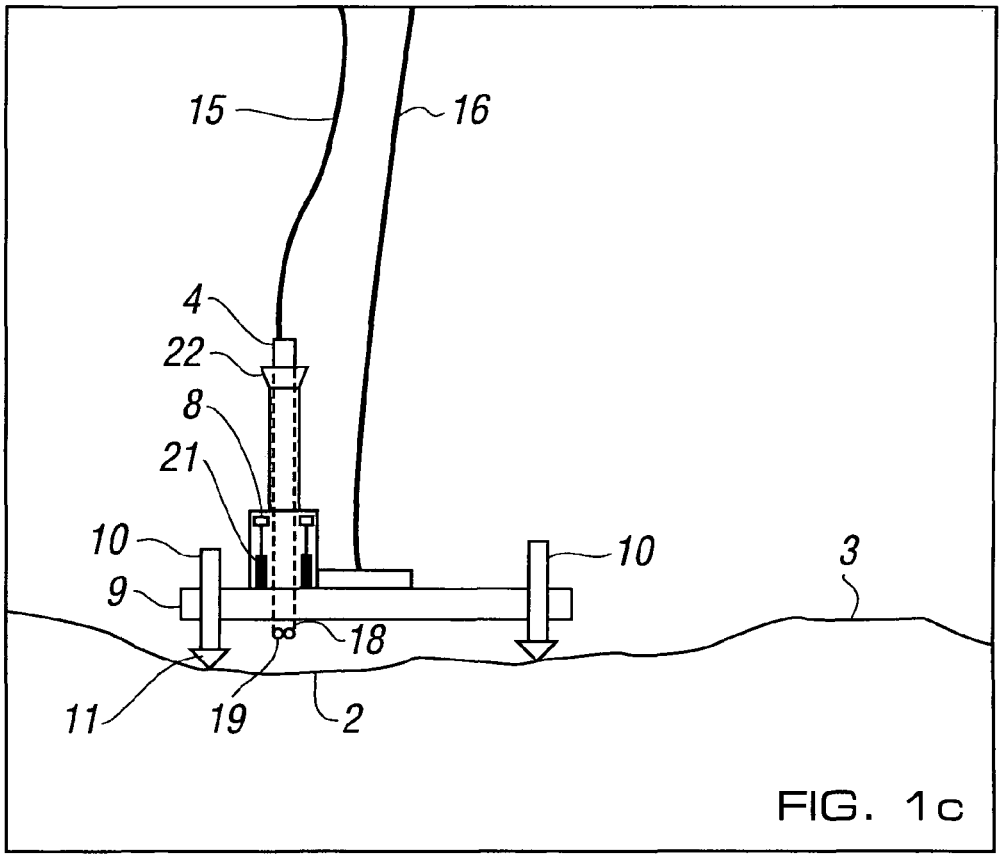

This leveling operation is discussed in relation to FIG. 1*c* from which it will be noted that the drilling rig platform 9 has been set to a horizontal operational setting by appropriate height adjustment of the legs 10 together with any lateral positional adjustment to position the column/pile above the lake, sea or riverbed location 2 at which it is to be positioned and to ensure that the platform 9 is positionally stable. As mentioned this positional adjustment of the drilling machine 8 may be effected by using hydraulic or electrical actuators (not shown) controlled from the vessel 1 by way of the umbilical connections 15/16.

In practice lateral forces exerted upon the drilling machine by the action of currents and waves are reacted through the legs 10 into the sea/river bed by means of friction.

In the embodiment shown the socket/bore 17 for receiving the column/pile is created by a rotary drilling operation using the lower/toe end 18 of the column/pile 4 as a drill bit. For this purpose the lower end/toe 18 of the column/pile 4 is equipped with cutters 19 regarded as being suitable for the expected lake, sea or river bed conditions. The required rotational drilling torque is applied to the column/pile by a rotary drill drive. The required force necessary to move the column/pile downwards during the drilling rotation is supplied by the weight of the column/pile. If, in practice, this is found not to be sufficient the column/pile can be ballasted by the application of weight to the column/pile. If necessary, additional force can be obtained from hydraulic cylinders 21.

A guide tube 22 within which the column/pile 4 is located whilst on the drilling machine serves to maintain the column/pile 4 in a vertical position during the drilling operation. In practice, power for the drilling operation and the control of the actual drilling operation is derived from the vessel 1 by way of the umbilicals 15 and 16. Furthermore other services to the column/pile such as compressed air for the removal of drilling debris/cuttings can be supplies by way of the umbilicals 15 and 16 between the vessel 1 and the drilling machine 8.

Figure 1D:
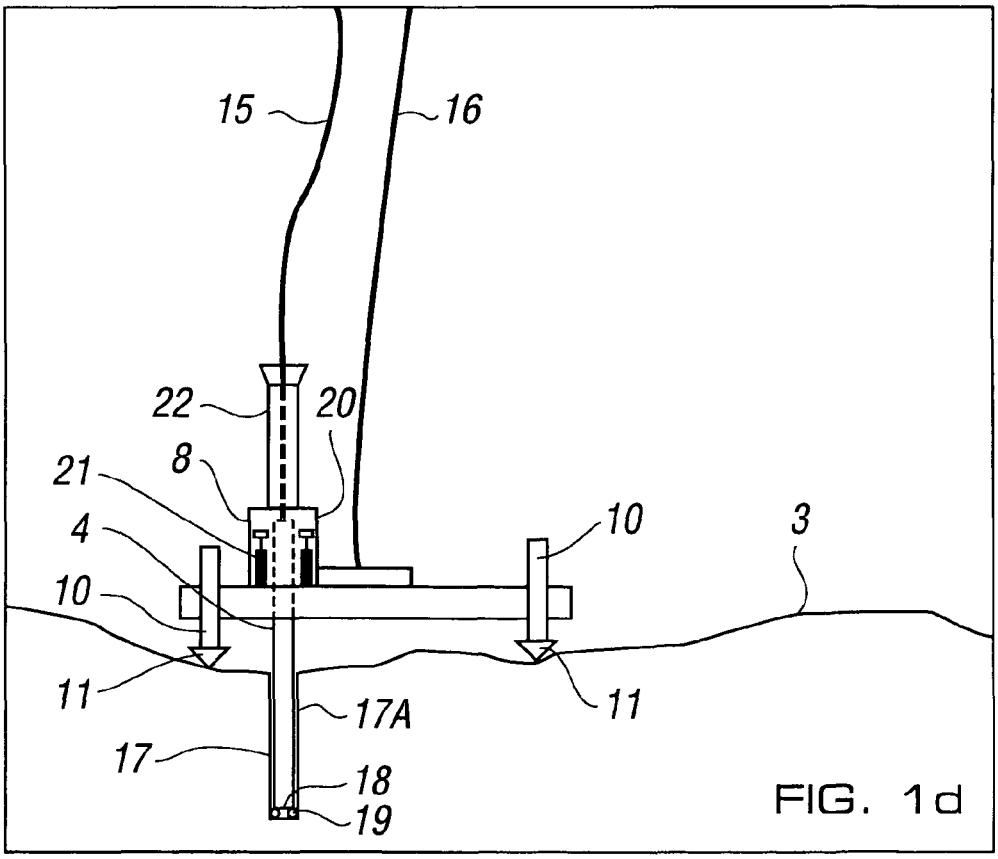

Referring now to FIG. 1*d*, this Figure schematically illustrates the stage at which the column/pile 4 has been advanced to a required depth in the lake, sea or river bed 3. At this stage the annulus 17A that has been produced by the drilling operation around inserted part of the column/pile 4 needs to be filled with grout to ensure that the column/pile 4 is firmly secured in position. This grout can be mixed on the vessel 1 and can be fed to the annulus 17A by the umbilical 15 used for the pumping in of air. Once the annulus 17 has been filed the umbilicals 15, 16 can be released and recovered to the surface vessel.

In situations in which it is required to insert into the lake, sea or river bed 3 more than one column/pile 4, for example, in close relationship to each other the drilling unit 20 and in particular the column/pile guide 22, the torque drive and associated hydraulic cylinders 21 can be moved to the required location for the next column/pile 4 to be inserted in the lake, sea or river bed.

Figure 1E:
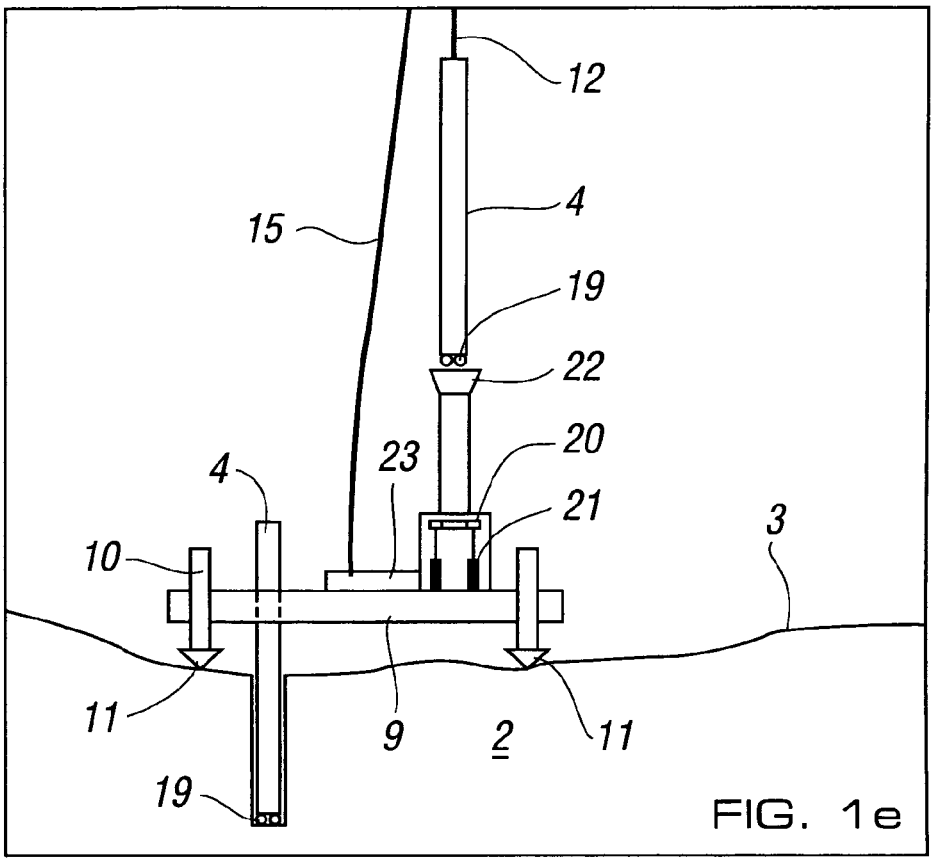

This displacement can be achieved in many different ways, for example, by using a yaw drive to move the drilling unit 20 to a new position as is illustrated in FIG. 1*e*. A new column/pile 4 can then be lowered into the guide tube 22 from the vessel 1. It is to be noted that the first column/pile 4 to be installed could be separate from the deploying of the drilling machine 8 to the lake, sea or river bed. In this case the drilling machine can be deployed without the column/pile 4 being in place In particular as may be seen from FIG. 1*e* once the displacement of the drilling machine 8 has been effected that is the guide tube 22 has been set above the position 2 in which the next column/pile 4 is to be inserted into the lake, sea or river bed 3 the next column/pile 4 to be inserted is lowered from the vessel 1 and entered into the guide tube 22.

As is indicated in FIG. 1*e* this is shown as being located to the right of the position shown in FIGS. 1*c* and 1*d*. In other words the guide tube 22 and associated drill unit 20 can be displaced relative to the drilling machine platform 9 by a drive unit 23 which is such as to displace the guide tube 22 to a selected one of a number of possible operational positions relative to the platform 9.

Figure 1F:
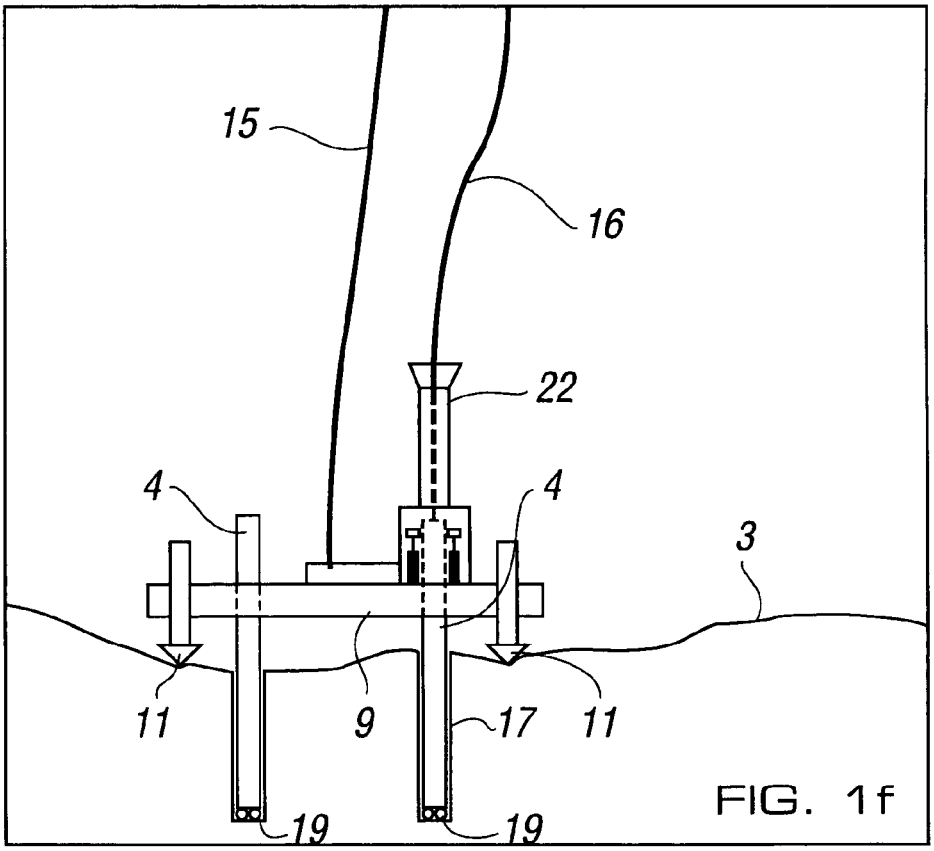

FIG. 1*f* illustrates an installation stage in which the first column/pile 4 has been inserted and the guide tube 22 has been moved to the next required position and the next column/pile 4 to be mounted in the lake, sea or river bed has been installed in a manner as discussed in relation to FIGS. 1*c* and 1*d* and grout has been or is being inserted into the annulus 17 produced in the lake, sea or river bed by the drilling operation.

The above discussed process is repeated for each column/pile 4 to be positioned in the lake, sea or river bed 3.

Once the drilling pile installation has been completed the machine 8 is withdrawn by the winch assembly to be repositioned onto the vessel. This is illustrated in FIG. 1*g*.

Figure 1G:
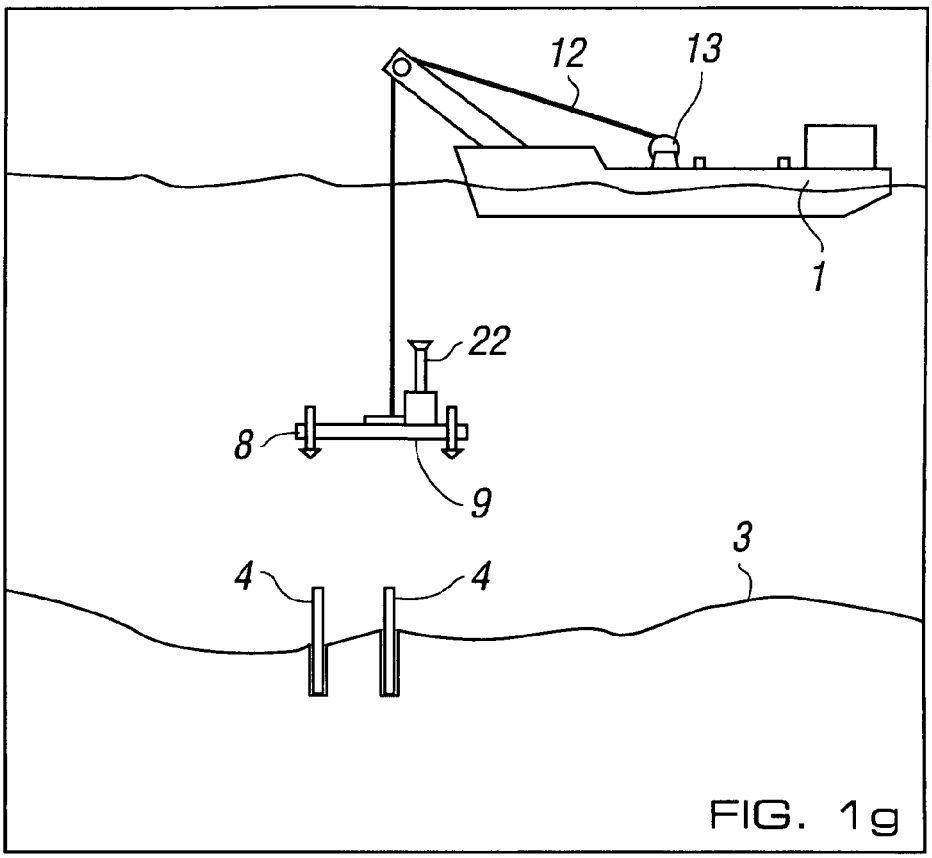
Figure 1H:
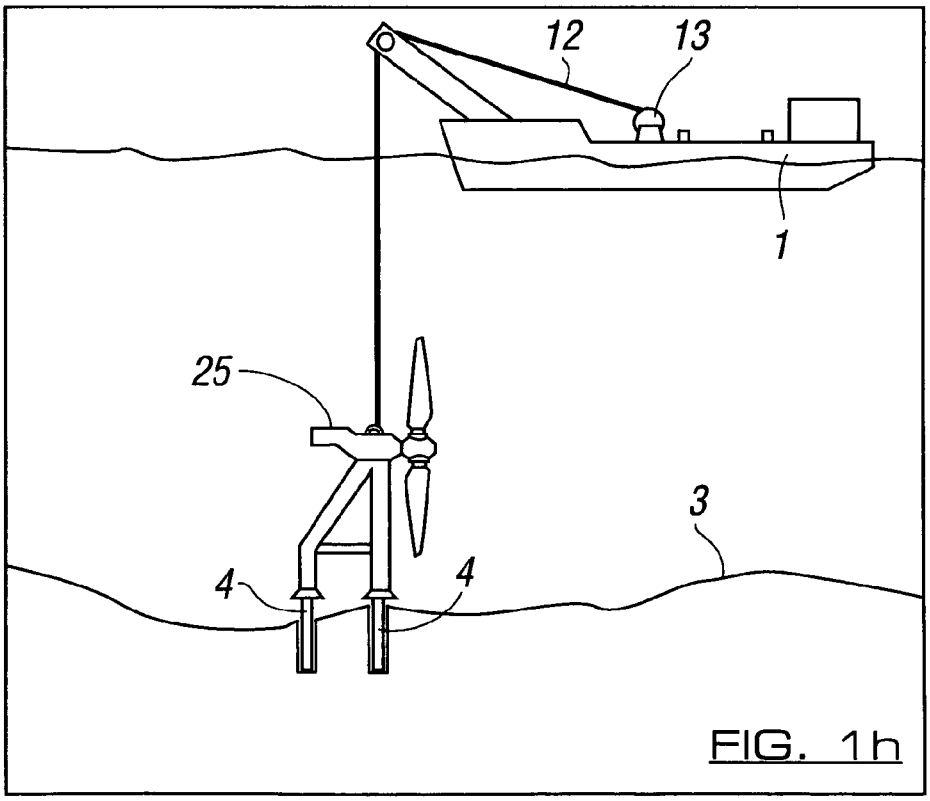

It will be noted from FIG. 1*g* that a series of columns/piles 4 are upstanding from the lake, sea or river bed. FIG. 1*h* illustrates very schematically the mounting of a turbine and rotor installation 25 being mounted to the columns/piles previously inserted as herein before described in relation to the previously discussed FIGS. 1*a* to 1*g*.

Figure 2A:
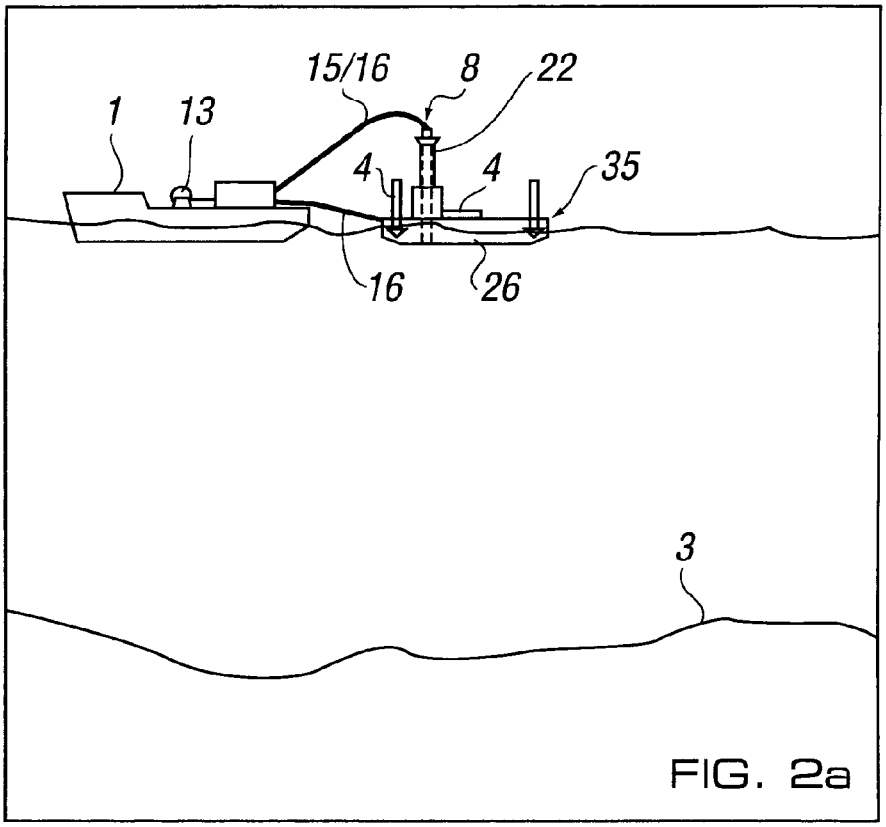
FIGS. 2*a* and 2*b* schematically illustrate a second embodiment of apparatus for installing and mounting a column/pile upon a lake, sea or river bed and FIG. 3. schematically illustrates a further embodiment of the apparatus for installing and mounting a column/pile upon a lake, sea or river bed.
Figure 2B:
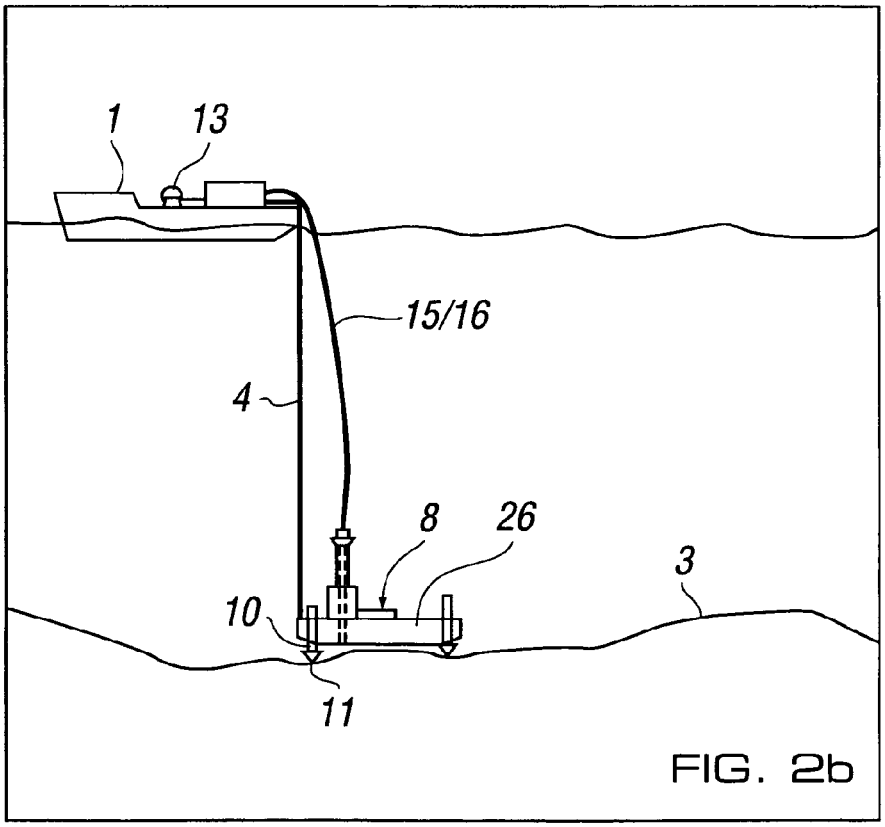

Referring now to FIGS. 2*a* and 2*b* which illustrate a second embodiment of a drilling machine apparatus 35 in which the platform of the previous Figures is effectively replaced by arrangement of sealed ballast tanks 26 which when filled with air are able to float in water so that they drilling machine can be moved to a required drilling position by being towed by the control vessel 1.

With this embodiment once the drilling machine 8 has been positioned in the required position for inserting a column/pile 4, the ballast tanks 26 are partially flooded with water to an extent that the ballast tanks and the associated drilling machine 8 exhibits a slightly negative buoyancy so that the drilling machine 8 can be lowered to the lake, sea or river bed 3 by the winch assembly 13. Once the drilling machine 8 is at the lake, sea or river bed 3 and the drilling machine 8 has been leveled so the drilling machine platform 9 is horizontal and the guide tube 22 is vertical the ballast tanks 26 are fully flooded with water thereby maximizing the submerged weight of the drilling machine 8 and therefore its frictional engagement with the lake, sea or river bed 3. After the required number of columns/piles 4 have been inserted into the lake, sea or river bed 3, the water is exhausted from the ballast tanks 26 to cause the drilling machine 8 to be readily liftable back to the vessel 1.

Figure 3:
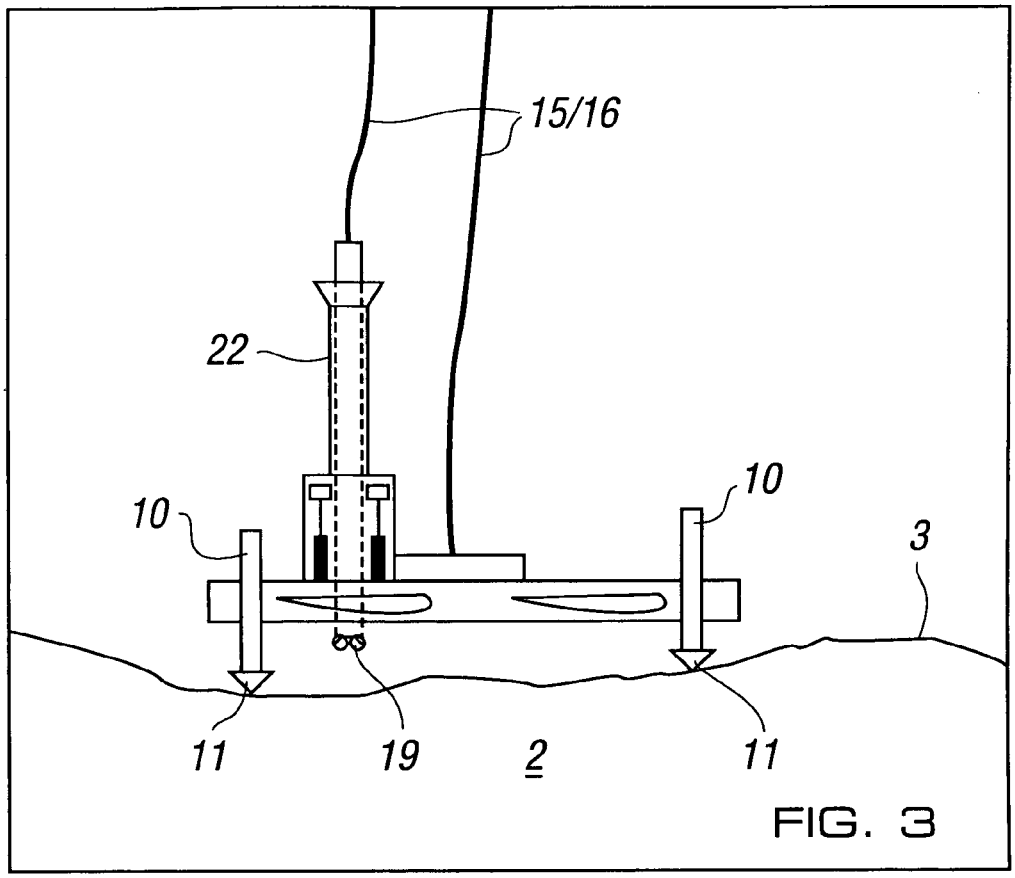

FIG. 3 schematically illustrates a further embodiment of a drilling machine 8 which is such that weight required to stabilize the drilling machine whilst on a lake, sea or river bed 3 is reduced. For this purpose the machine is provided with positionally adjustable hydrofoils settable such that down force is produced by tide or river flows, thereby increasing the requisite friction between the machine feet 11 and the lake, sea or bed 3 thereby helping to counteract water flow drag on the drilling machine.

We claim:

1. A method of mounting one or more columns/piles in an upstanding position on a supporting surface formed by a lake, sea or river bed comprising the steps of:

using a submersible drilling machine for mounting the one or more columns/piles to be inserted in the supporting surface, lowering the column/pile to be installed from a support vessel into contact with the supporting surface, remotely operating from the support vessel one or more drilling mechanisms by way of one or more flexible umbilicals, leaving the column/pile in situ in a bore formed after completion of a drilling operation, and following the drilling operation, recovering the drilling machine by the support vessel, wherein using lower/toe end of the column/pile as a non-retrievable drill such that upon rotation of the column/pile the bore is formed in the supporting surface into which a lower region of the column/pile is to be located, wherein the drilling machine comprises means for enabling the one or more drilling mechanisms of the drilling machine to be positionally indexed from a site of the drilling operation to another site for a subsequent drilling operation without moving the drilling machine, such that a predetermined pattern of column/piles can be established without moving the entire drilling machine, and wherein the one or more drilling mechanisms comprises a guide tube for vertically inserting a further column/pile to be installed.

2. The method as claimed in claim 1, and comprising the step of using a reverse fluid circulation during the drilling operation, such that drill cutting debris is discharged into water at a head of the column/pile by using a flow of compressed air derived from the support vessel by way of a flexible umbilical.

3. The method as claimed in claim 1, and comprising the step of using a forward fluid circulation during the drilling operation such that drill cutting debris is discharged into water at the lake, sea or river bed within which drilling takes place using a flow of fluid supplied from the support vessel by way of a flexible umbilical.

4. The method as claimed in claim 1, comprising the step of deploying the drilling machine from the surface support vessel so that the drilling machine rests on the supporting surface, wherein the one or more flexible umbilicals are for delivering power to and for controlling the drilling operation of the drilling machine, and wherein, after recovering the drilling machine by the support vessel, the one or more columns/piles are left upstanding from the supporting surface.

5. An arrangement for installing one or more foundation columns/piles in a lake, river or sea bed, comprising a submersible drilling machine incorporating one or more drilling mechanisms, the drilling machine being deployable with the aid of a surface support vessel so as to be able to rest on the lake, river, or sea bed as to be fully supportable by the lake, river or sea bed, means for remotely operating from the support vessel the one or more drilling mechanisms by way of one or more flexible umbilicals for delivering power to and for controlling the drilling machine, whereby following a required drilling operation the drilling machine is recoverable by the support vessel thereby to leave one or more columns/piles upstanding from the lake, river or sea bed, wherein, each column/pile is a non-retrievable drill bit by which the lake, river or sea bed is drilled into, wherein the drilling machine comprises means for enabling the one or more drilling mechanisms of the drilling machine to be positionally indexed from a site of the drilling operation to another site for a subsequent drilling operation without moving the drilling machine, such that a predetermined pattern of column/piles can be established without moving the entire drilling machine, and wherein the one or more drilling mechanisms comprises a guide tube for vertically inserting a further column/pile to be installed.

6. The arrangement as claimed in claim 5, wherein the drilling machine incorporates telescopic legs or otherwise articulated members whereby an operational position of the drilling machine is positionally adjustable relative to a support surface in such manner as to level the drilling machine, so that the one or more drilling mechanisms are able to produce vertical bores in the supporting surface.

7. The arrangement as claimed in claim 5, wherein the drilling machine incorporates position adjustment actuators.

8. The arrangement as claimed in claim 7, wherein the adjustment actuators comprise hydraulic cylinders, pneumatic cylinders, bags or bladders.

9. The arrangement as claimed in claim 5, wherein, when the or each column/pile to be installed is cylindrical, the column/pile comprises at a lower/toe end rock or soil cutters such that on rotation of the column/pile about a longitudinal axis the column/pile effectively acts as a rotary drill, and wherein the drilling machine incorporates means for rotating the column/pile thereby to perform the drilling operation.

10. The arrangement as claimed in claim 5, wherein the drilling machine is recoverable to the support vessel whereby the drilling machine can be equipped with the further column/pile and returned to a different location of the drilling machine, the arrangement being such as to allow the columns/piles to be installed in the predetermined pattern without moving the entire drilling machine.

11. The arrangement as claimed in claim 5, wherein the drilling machine comprises means utilizing a flow of water in the vicinity of the drilling machine to create a net force that assists gravity in holding the drilling machine onto the lake, river or sea bed.

12. The arrangement as claimed in claim 11, wherein the means utilizing the flow of water comprises hydrofoils.

* * * * *